US009073320B2

(12) United States Patent
Zhang

(10) Patent No.: US 9,073,320 B2
(45) Date of Patent: Jul. 7, 2015

(54) LIQUID EJECTING HEAD AND LIQUID EJECTING APPARATUS

(71) Applicant: Seiko Epson Corporation, Tokyo (JP)

(72) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/225,056

(22) Filed: Mar. 25, 2014

(65) Prior Publication Data

US 2014/0292944 A1 Oct. 2, 2014

(30) Foreign Application Priority Data

Mar. 27, 2013 (JP) ..... 2013-067655

(51) Int. Cl.
*B41J 2/045* (2006.01)
*B41J 2/14* (2006.01)

(52) U.S. Cl.
CPC ..... *B41J 2/14233* (2013.01)

(58) Field of Classification Search
CPC ..... B41J 2/14072; B41J 2/1401; B41J 2/161; B41J 2/14274; B41J 2/14298; B41J 2/14201; B41J 2/14233
See application file for complete search history.

(56) References Cited

U.S. PATENT DOCUMENTS

| | | | | |
|---|---|---|---|---|
| 6,113,225 | A * | 9/2000 | Miyata et al. | 347/70 |
| 2002/0075362 | A1 | 6/2002 | Nakamura et al. | |
| 2005/0068375 | A1 | 3/2005 | Hibi et al. | |
| 2005/0168536 | A1 * | 8/2005 | Katayama | 347/70 |

FOREIGN PATENT DOCUMENTS

| | | | |
|---|---|---|---|
| JP | 2002-248765 | A | 9/2002 |
| JP | 2007-237746 | A | 9/2007 |

* cited by examiner

*Primary Examiner* — Geoffrey Mruk
(74) *Attorney, Agent, or Firm* — Kilpatrick Townsend & Stockton LLP

(57) ABSTRACT

An ink jet type recording head includes a plurality of pressure generation chambers which are filled with ink, and piezoelectric elements which eject ink droplet through nozzle openings which are provided so as to correspond to each pressure generation chamber by applying pressure to the ink in each pressure generation chamber. The pressure generation chamber has a shape such that the piezoelectric element in the opposite side to a protrusion side in which at least a portion of the piezoelectric element protrudes out of the pressure generation chamber is deformed more easily than that in the protrusion side.

14 Claims, 9 Drawing Sheets

LIQUID EJECTING HEAD AND LIQUID EJECTING APPARATUS

This application claims priority to Japanese Application No. 2013-067655, filed on Mar. 27, 2013, the entirety of which is incorporated by reference herein.

BACKGROUND

1. Technical Field

The present invention relates to a liquid ejecting head and a liquid ejecting apparatus which eject liquid from a nozzle opening, and particularly to an ink jet type recording head and an ink jet type recording apparatus which eject ink as liquid.

2. Related Art

For example, an ink jet type recording head which is an example of a liquid ejecting head includes an actuator unit in which a piezoelectric element and a pressure generation chamber are provided, and a flow path unit having a nozzle plate in which a nozzle opening which communicates with the pressure generation chamber and ejects ink and a manifold forming substrate in which a manifold is provided which is a common ink chamber of the pressure generation chamber is provided.

A shape of the pressure generation chamber in such an ink jet type recording head is generally formed in a rectangular shape, but a pressure generation chamber is proposed which is formed in a circular shape so that merits of high driving efficiency is utilized and a driving efficiency is improved by decreasing a flexural deformation restriction of a driving unit by an electrode pad (refer to JP-A-2002-248765), or a parallelogram shape so that a structural crosstalk is decreased and the shape of the pressure generation chamber corresponds to an individual electrode in an approximate parallelogram shape (refer to JP-A-2007-237746). Here, an expression "a shape of the pressure generation chamber" means a shape of the pressure generation chamber projected on a plane parallel to the nozzle plate in which the nozzle opening is formed (hereinafter, this is similarly applied to the present specification).

However, if displacement efficiency of the piezoelectric element is improved, the possibility of failure increases due to an electrode pad.

Such a problem exists not only in the ink jet type recording head, but also in a liquid ejecting head which ejects any other liquid than ink.

SUMMARY

An advantage of some aspects of the invention is that it provides a liquid ejecting head and a liquid ejecting apparatus which have more improved operation ratios.

According to an aspect of the invention, there is provided a liquid ejecting head including: a plurality of pressure generation chambers which are filled with liquid; and piezoelectric elements which eject liquid droplet through nozzle openings which are provided so as to correspond to each pressure generation chamber by applying pressure to the liquid in each pressure generation chamber, in which the pressure generation chamber has a shape such that the piezoelectric element in an opposite side to a protrusion side in which at least a portion of the piezoelectric element protrudes out of the pressure generation chamber is deformed more easily than that in the protrusion side.

According to the aspect, the shape of the pressure generation chamber is formed such that the piezoelectric element in the opposite side to the protrusion side protruding out of the pressure generation chamber is easily deformed, and thus the piezoelectric element can be satisfactorily displaced, and displacement efficiency in the opposite side, that is, an area corresponding to the nozzle opening can be increased. At the same time, it is possible to effectively prevent a rapid increase in displacement in the protrusion side. As a result, it is possible to not only reduce stress concentration but also simultaneously realize an improvement of the displacement efficiency and a long lifetime of the piezoelectric element. In addition, a crosstalk can also be effectively prevented.

Here, it is preferable that the pressure generation chamber has a shape such that a width of the pressure generation chamber in a direction orthogonal to the protrusion direction within a predetermined distance from an end portion in the protrusion side where at least a portion of the piezoelectric element protrudes out of the pressure generation chamber, is narrower than a width of the pressure generation chamber in the direction orthogonal to the protrusion direction within the predetermined distance from an end portion in the opposite side to the protrusion side of the pressure generation chamber.

In this case, the width of the end portion in the protrusion side is narrow, and thus it is possible to reliably prevent the rapid increase in displacement in the protrusion side. As a result, the stress concentration can be reduced.

In addition, it is preferable that the piezoelectric element includes a common electrode which is common to the plurality of piezoelectric elements, a piezoelectric element layer, and an individual electrode which is provided in each piezoelectric element, and the protrusion direction be a direction in which the individual electrode protrudes out of the pressure generation chamber. Further, it is preferable that the individual electrode be formed along the shape of each pressure generation chamber. In this case, the displacement of the piezoelectric element can affect liquid in the pressure generation chamber with a high efficiency. However, the individual electrode may also be formed in a rectangular shape.

It is preferable that the pressure generation chambers be configured so as to be in a staggered arrangement in which a position of the nozzle opening corresponding to those adjacent in a direction, which is orthogonal to the protrusion direction, in which the pressure generation chambers are provided in parallel, is shifted with regard to the protrusion direction. In this case, the nozzle openings are configured to be in the staggered arrangement, and thus it is possible to easily realize high density of the nozzle openings.

It is preferable that one of the pressure generation chambers adjacent in the direction in which the pressure generation chambers are provided in parallel be arranged and provided such that the protrusion direction thereof is turned to the opposite side to the protrusion side in each pressure generation chamber, between other pressure generation chambers which are mutually adjacent to the one of the pressure generation chambers. Even in this case, it is possible to realize the high density by narrowing an interval between the pressure generation chambers adjacent to each other.

In addition, in the aspect of the invention, only the shape of the piezoelectric element which includes the upper electrode film integrated with the electrode pad through the connection wire may be formed in various shapes as described above while the pressure generation chamber be formed in a rectangular shape. That is, according to another aspect of the invention, there is provided a liquid ejecting head including: a plurality of pressure generation chambers which are filled with liquid; and piezoelectric elements which eject liquid droplet through nozzle openings which are provided so as to correspond to each pressure generation chamber by applying pressure to the liquid in each pressure generation chamber, in which the upper electrode film has a shape such that the piezoelectric element in the opposite side to the protrusion side in which at least a portion of the piezoelectric element protrudes out of the pressure generation chamber is deformed more easily than that in the protrusion side.

Even in the aspect, it is possible to obtain the same effect as the case where the pressure generation chamber is formed in the shape described in the above-described aspect, with respect to the improvement of the displacement efficiency and the reduction of the stress concentration.

Here, it is preferable that a width of the upper electrode film in the direction orthogonal to the protrusion direction within a predetermined distance from the end portion in the protrusion side in which at least a portion of the upper electrode film protrudes out of the pressure generation chamber, be narrower than a width of the upper electrode film in the direction orthogonal to the protrusion direction within the predetermined distance from the end portion in the opposite side to the protrusion side. In addition, a configuration in which the piezoelectric element includes a common electrode which is common to the plurality of piezoelectric elements, a piezoelectric element layer, and an individual electrode which is provided in each piezoelectric element, and the protrusion direction is a direction in which the individual electrode protrudes out of the pressure generation chamber, a configuration in which the pressure generation chambers are configured so as to be in a staggered arrangement in which a position of the nozzle opening corresponding to those adjacent in a direction, which is orthogonal to the protrusion direction and in which the pressure generation chambers are provided in parallel, is shifted with regard to the protrusion direction, and a configuration in which one of the pressure generation chambers adjacent in the direction in which the pressure generation chambers are provided in parallel is arranged and provided such that the protrusion direction thereof is turned to the opposite side to the protrusion side in each pressure generation chamber, between other pressure generation chambers which are mutually adjacent to the one of the pressure generation chambers, can be arbitrarily adopted.

According to still another aspect of the invention, there is provided a liquid ejecting apparatus which includes the liquid ejecting head described above.

According to the aspect, it is possible to realize the liquid ejecting apparatus whose liquid ejecting characteristics are improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the drawings.

Figure 1:
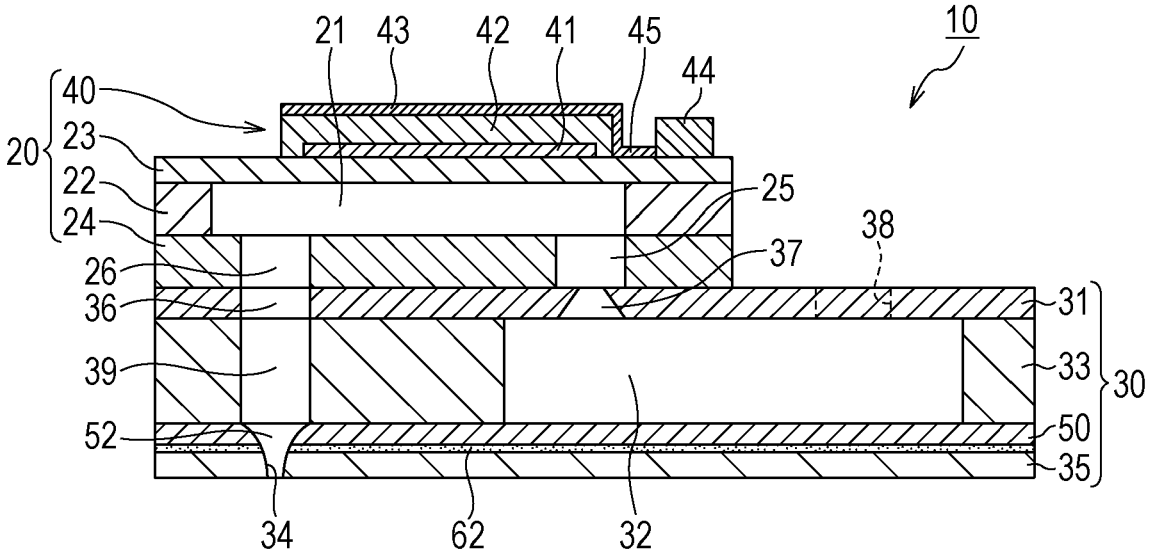
FIG. 1 is a sectional view of a recording head according to an embodiment of the present invention.
Figure 2:
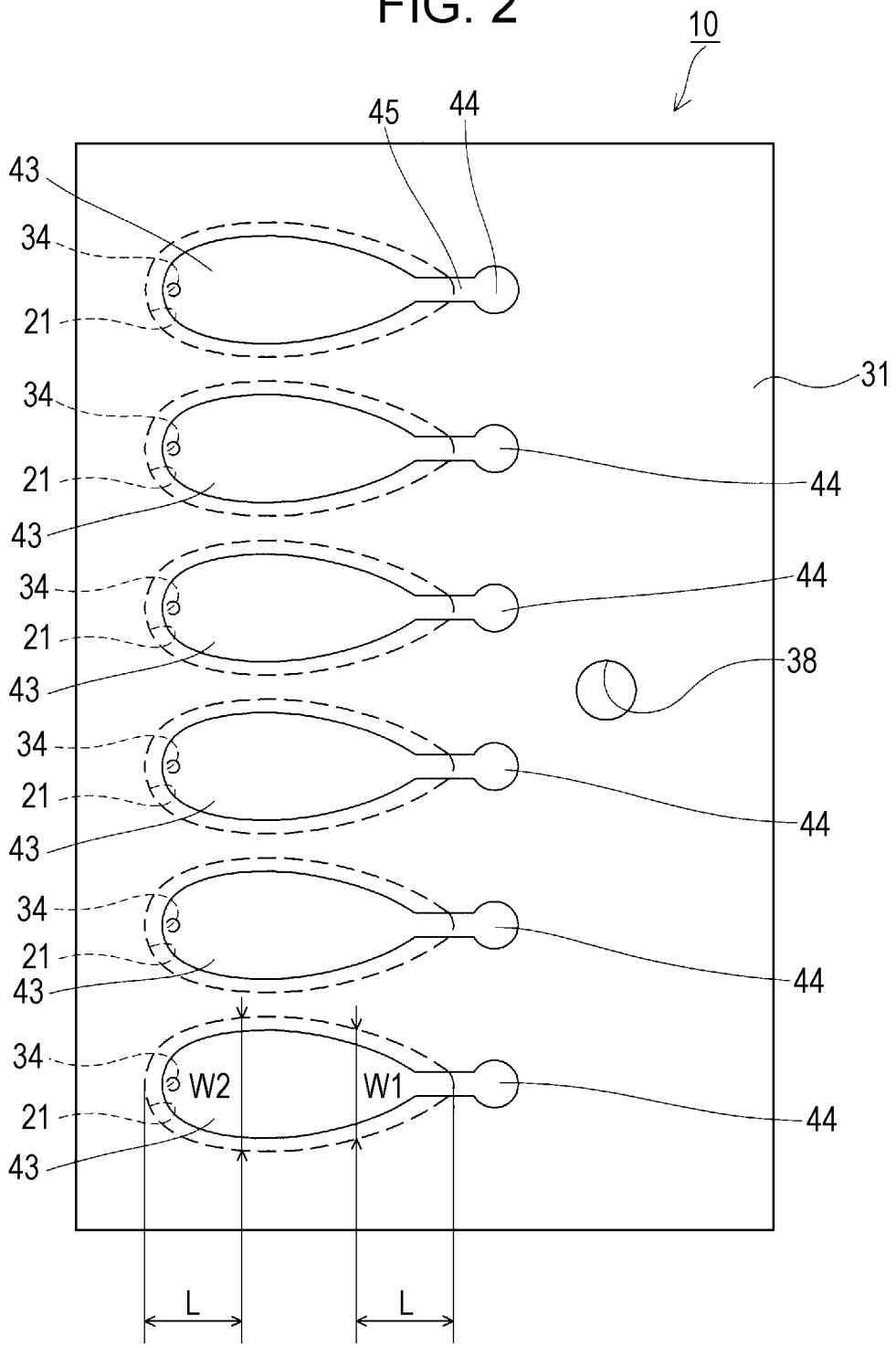
FIG. 2 is a plan view of essential parts of a recording head according to an embodiment of the present invention.

FIG. 1 is a sectional view of an ink jet type recording head illustrating an example of a liquid ejecting head according to an embodiment of the invention, and FIG. 2 is a plan view of essential parts of an ink jet type recording head.

As illustrated in FIGS. 1 and 2, the ink jet type recording head 10 according to the present embodiment is configured by an actuator unit 20, and a flow path unit 30 to which the actuator unit 20 is fixed.

The actuator unit 20 is an actuator apparatus which includes a piezoelectric element 40, and includes, a flow path forming substrate 22 in which a pressure generation chamber 21 is formed, a vibration plate 23 which is provided in one side of the flow path forming substrate 22, and a pressure generation chamber bottom plate 24 which is provided in other side of the flow path forming substrate 22.

For example, the flow path forming substrate 22 is formed from a ceramic plate such as alumina ($Al_2O_3$) or zirconia ($ZrO_2$) which has a thickness of approximately 150 μm, and in the present embodiment, a plurality of pressure generation chambers 21 are provided side by side along a width direction thereof. Then, for example, the vibration plate 23 which is formed from a thin plate of stainless steel (SUS) with a thickness of 10 μm to 12 μm is fixed to one side of the flow path forming substrate 22, and one side of the pressure generation chamber 21 is sealed by the vibration plate 23. Here, the pressure generation chamber 21 according to the present embodiment, as illustrated in FIG. 2, has a shape such that the piezoelectric element 40 in an opposite side (left in FIG. 2) to a protrusion side (right in FIG. 2) in which at least a portion of the piezoelectric element 40 protrudes out of the pressure generation chamber 21 is deformed more easily than that in the protrusion side, and in which a width of an end portion in the protrusion side is narrower than that in the opposite side. The shape of the pressure generation chamber 21 will be described in detail later.

For example, the vibration plate 23 which is formed from the thin plate of the stainless steel (SUS) with a thickness of 10 μm to 12 μm is fixed to the one side of the flow path forming substrate 22, and the one side of the pressure generation chamber 21 is sealed by the vibration plate 23. The pressure generation chamber bottom plate 24 is fixed to other side of the flow path forming substrate 22 and seals other side of the pressure generation chamber 21, and includes, a supply communication hole 25 which is provided near one end portion of the pressure generation chamber 21 in a longitudinal direction and communicates with both the pressure generation chamber 21 and a manifold described later, and a nozzle communication hole 26 which is provided near the other end portion of the pressure generation chamber 21 in the longitudinal direction and communicates with a nozzle opening 34 which will be described later. Then, the piezoelectric element 40 is provided in each area opposing each pressure generation chamber 21 on the vibration plate 23.

Here, each piezoelectric element 40 is configured by a lower electrode film 41 which is provided on the vibration plate 23, a piezoelectric layer 42 which is independently provided in each pressure generation chamber 21, an upper electrode film 43 which is provided on an upper surface of each piezoelectric layer 42 so as to correspond thereto and is an individual electrode, an electrode pad 44 which is positioned outside the pressure generation chamber 21, and a connection wire 45 which is a wire connecting the upper electrode film 43 to the electrode pad 44. Here, the upper electrode film 43, the electrode pad 44, and the connection wire 45 are integrally formed. Then, the electrode pad 44 is formed on the vibration plate 23 so as to be higher than the connection wire 45. The piezoelectric layer 42 is formed by sticking a green sheet which is made of piezoelectric material, or by printing. In addition, the lower electrode film 41 is provided over the piezoelectric layers 42 which are provided side by side, is a common electrode of each piezoelectric element 40, and functions as a portion of the vibration plate. Of course, the lower electrode film 41 may be provided in each piezoelectric layer 42.

The flow path forming substrate 22, the vibration plate 23, and the pressure generation chamber bottom plate 24 which configure each layer of the actuator unit 20 are integrated with each other by forming ceramic material like clay, a so-called green sheet in a predetermined thickness, by boring, for example, the pressure generation chamber 21 or the like, by stacking and baking the flow path forming substrate 22, the vibration plate 23, and the pressure generation chamber bottom plate 24, without an adhesive being used. Thereafter, the piezoelectric element 40 is formed on the vibration plate 23.

On the other hand, the flow path unit 30 is configured by a liquid supply hole forming substrate 31 which is bonded to the pressure generation chamber bottom plate 24 of the actuator unit 20, a manifold forming substrate 33 in which the manifold 32, which is a common ink chamber of a plurality of pressure generation chambers 21, is formed, a substrate 50 which is provided in a side opposing the liquid supply hole forming substrate 31 of the manifold forming substrate 33, and a nozzle plate 35 in which the nozzle opening 34 is formed.

The liquid supply hole forming substrate 31 is formed from a thin plate of stainless steel (SUS) with a thickness of 60 μm, and has a bored a nozzle communication hole 36 which connects the nozzle opening 34 to the pressure generation chamber 21, and a bored liquid supply hole 37 which connects the pressure generation chamber 21 to the manifold 32 in combination with the supply communication hole 25. In addition, a liquid inlet 38 which communicates with each manifold 32 and through which ink from an external ink tank is supplied to each manifold 32, is provided in the liquid supply hole forming substrate 31. The liquid supply hole 37 and the liquid inlet 38 are provided in the longitudinal direction of the pressure generation chamber 21, that is, a direction orthogonal to one direction in which the pressure generation chambers 21 are provided side by side, and provided at respective both end portions of the manifolds 32 which will be described later so as to communicate with each other.

The manifold forming substrate 33 is formed from a plate member, which is suitable to configure an ink flow path (liquid flow path) and has corrosion resistance, of the stainless steel or the like with a thickness of 150 μm, and the manifold forming substrate 33 has the manifold 32 receiving the ink from the external ink tank (not illustrated) and supplying the ink to the pressure generation chamber 21, and a nozzle communication hole 39 communicating the pressure generation chamber 21 with the nozzle opening 34. The manifolds 32 are provided over the plurality of pressure generation chambers 21, that is, along a direction in which the pressure generation chambers 21 are provided side by side.

The substrate 50 is bonded to an surface in the opposite side to the liquid supply hole forming substrate 31 on the manifold forming substrate 33, and seals a bottom surface of the manifold 32. In addition, in the substrate 50, a nozzle communication hole 52 is provided which communicates the nozzle communication hole 39 which is provided in the manifold forming substrate 33 by penetrating through the manifold forming substrate 33 in a thickness direction thereof, with the nozzle opening 34. That is, the ink from the pressure generation chamber 21 is ejected from the nozzle opening 34 through the nozzle communication holes 36, 39 and 52 which are provided in the liquid supply hole forming substrate 31, the manifold forming substrate 33, and the substrate 50.

The nozzle plate 35 is formed from a plate shape member which is formed using a metal such as the stainless steel, or the ceramic material such as silicon. In the nozzle plate 35, the nozzle openings 34 are formed by boring in the same arrangement pitches as those between the pressure generation chambers 21.

Such a flow path unit 30 is formed by fixing the liquid supply hole forming substrate 31, the manifold forming substrate 33, the substrate 50, and the nozzle plate 35, using an adhesive, a heat welding film or the like. In FIG. 1, only an adhesive 62 which bonds the nozzle plate 35 to the substrate 50 is exemplarily illustrated, but an adhesive not illustrated is provided between other members which configure the flow path unit 30. Then, the flow path unit 30 and the actuator unit 20 are fixed by performing the bonding using the adhesive or the heat welding film.

Hereinafter, the shape of the pressure generation chamber according to the present embodiment will be described in further detail with reference to FIG. 2. As illustrated in FIG. 2, the pressure generation chamber 21 has a shape such that the piezoelectric element 40 in the opposite side to the end portion (right end portion in FIG. 2) of the electrode pad side of the piezoelectric element 40 in which the upper electrode film 43 which is the individual electrode protrudes out of the piezoelectric element 40 and which is integrated with the electrode pad 44, is deformed more easily than that in the electrode pad side. That is, the pressure generation chamber 21 in the opposite side has a relatively wide portion and has a shape to allow a large displacement of the piezoelectric element 40. At the same time, a width W1 of the pressure generation chamber 21 within a predetermined distance L from the end potion of the pressure generation chamber 21 in the electrode pad side is narrower than a width W2 of the pressure generation chamber 21 within a predetermined distance L from the end portion (left end portion in FIG. 2) of the pressure generation chamber 21 in the opposite side to the end portion of the pressure generation chamber 21 in the electrode pad side. That is, the shape of the end portion of the pressure generation chamber 21 in the electrode pad side is a pointed shape with the width W1 being gradually reduced, and is a shape such that the displacement of each portion of the piezoelectric element 40 can be slowly performed in the electrode pad side. Here, the shape of the piezoelectric element 40 is similar to the shape of the pressure generation chamber 21.

As the pressure generation chamber 21 is formed in the same manner as described above, the piezoelectric element 40 can be satisfactorily displaced in the end portion side of the pressure generation chamber 21 opposing the electrode pad 44, and it is possible to increase displacement efficiency in an area corresponding to the nozzle opening 34. At the same time, since the width W1 of the end portion of the pressure generation chamber 21 in the electrode pad 44 side is narrow, it is possible to decrease the displacement efficiency in the electrode pad 44 side. As a result, stress concentration can be reduced. According to this, a repeated stress on the connection wire 45 at the time of the displacement of the piezoelectric element 40 is decreased, and a disconnection of the connection wire 45 can be prevented from occurring.

In the ink jet type recording head 10 according to the present embodiment described above, the ink is supplied into the manifold 32 from an ink cartridge (storage unit) through the liquid inlet 38, and thereby an ink flow path between the manifold 32 and the nozzle opening 34 is filled with the ink. Thereafter, according to a recording signal from a driving circuit not illustrated, a voltage is applied to each piezoelectric element 40 corresponding to each pressure generation chamber 21, and then the piezoelectric element 40 and the vibration plate 23 are flexurally deformed. Therefore, a pressure in each pressure generation chamber 21 is increased, and then ink droplet is ejected from each nozzle opening 34.

Here, as described above, the shape of the pressure generation chamber 21 is formed as illustrated in the FIG. 2, and thus, the displacement efficiency in the opposite side to the electrode pad 44 side is increased, ejection of the ink droplet through the nozzle opening 34 can be satisfactorily performed, and the stress concentration on the piezoelectric element 40 in the electrode pad side can be reduced. As a result, both an increase of the displacement efficiency and a long lifetime of the piezoelectric element 40 can be realized. In addition, a crosstalk can also be effectively prevented from occurring.

Figure 3:
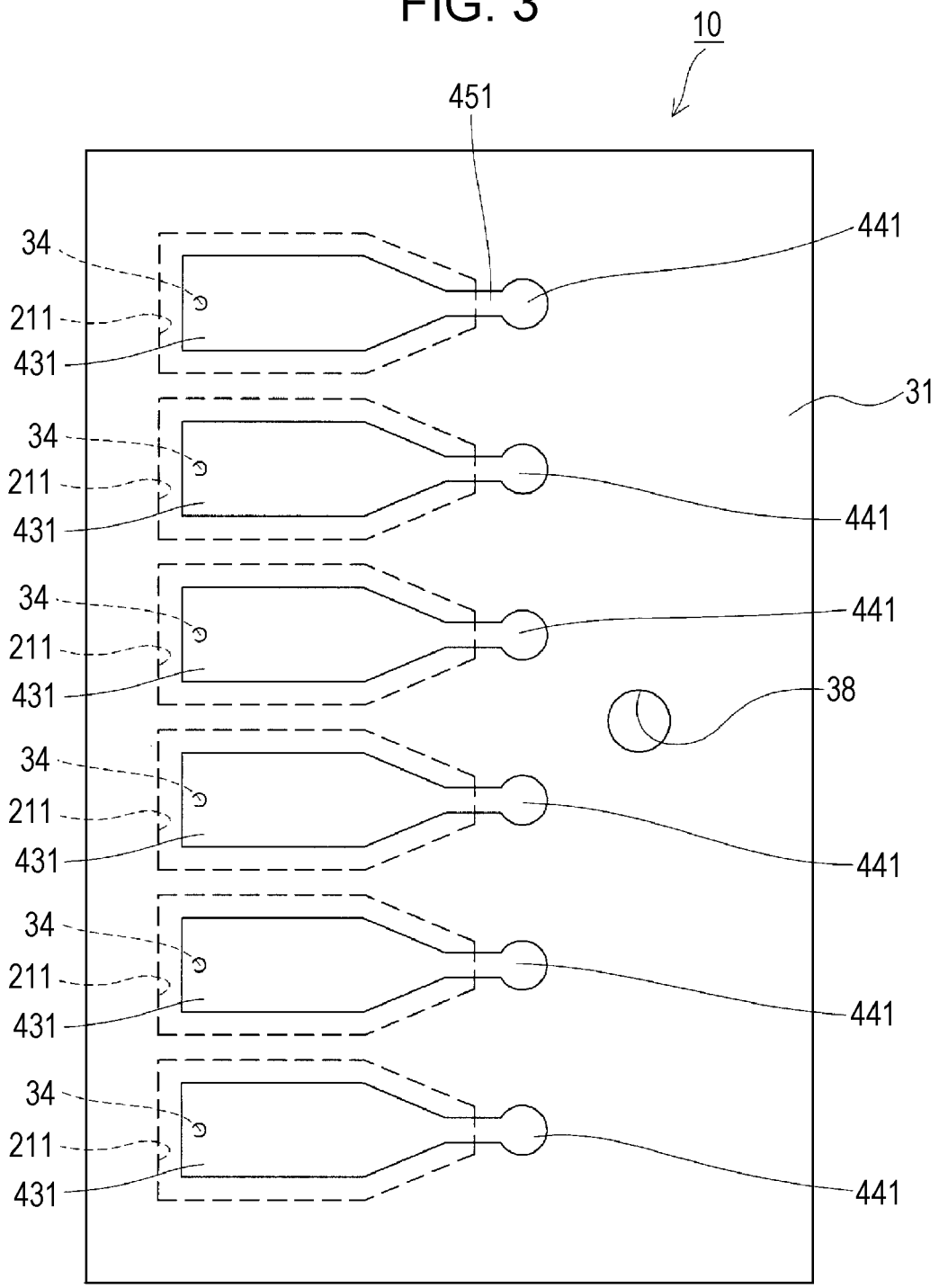
FIG. 3 is a plan view of essential parts for explaining a shape of a pressure generation chamber.
Figure 4:
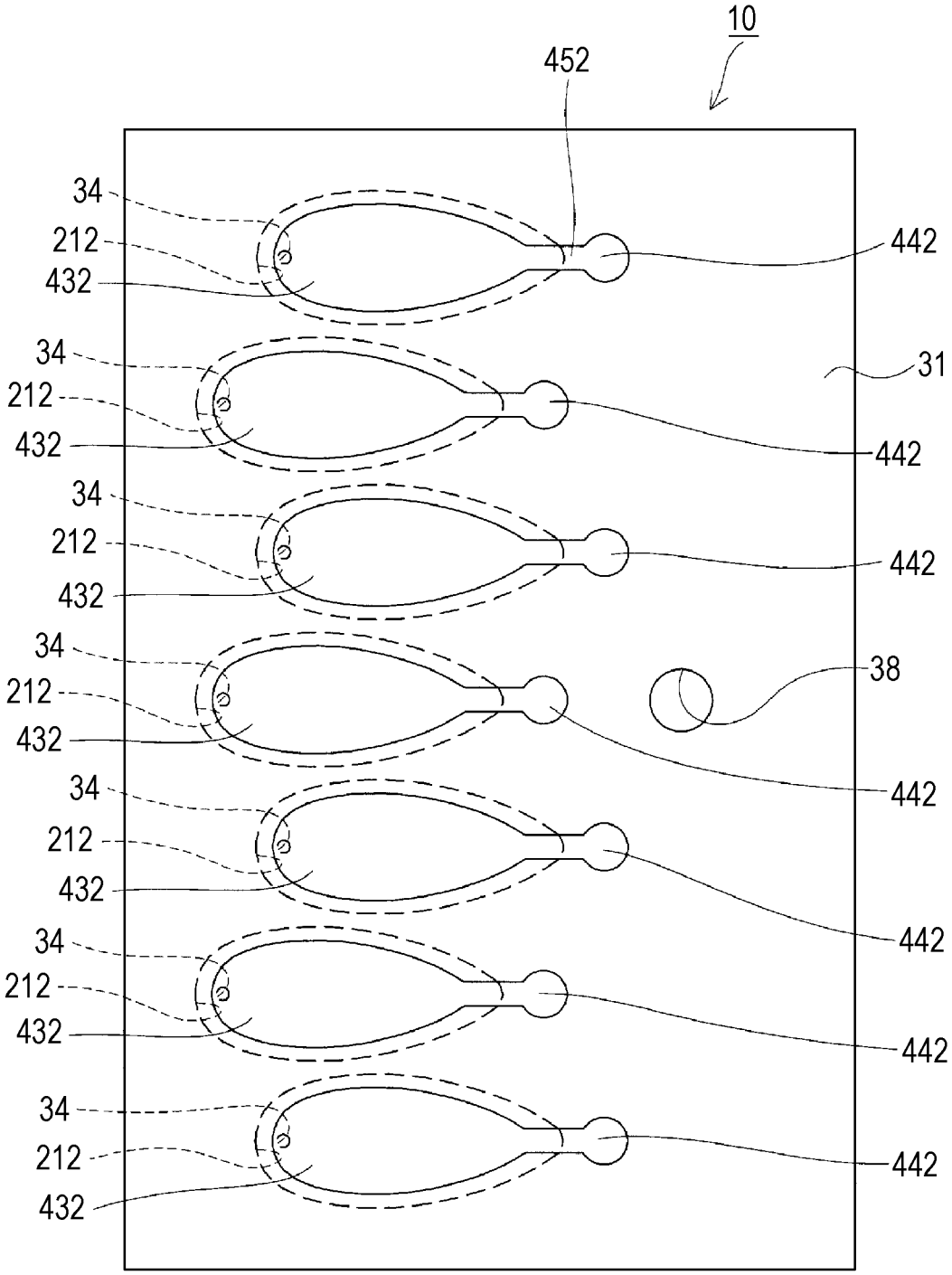
FIG. 4 is a plan view of essential parts for explaining a shape of a pressure generation chamber.
Figure 5:
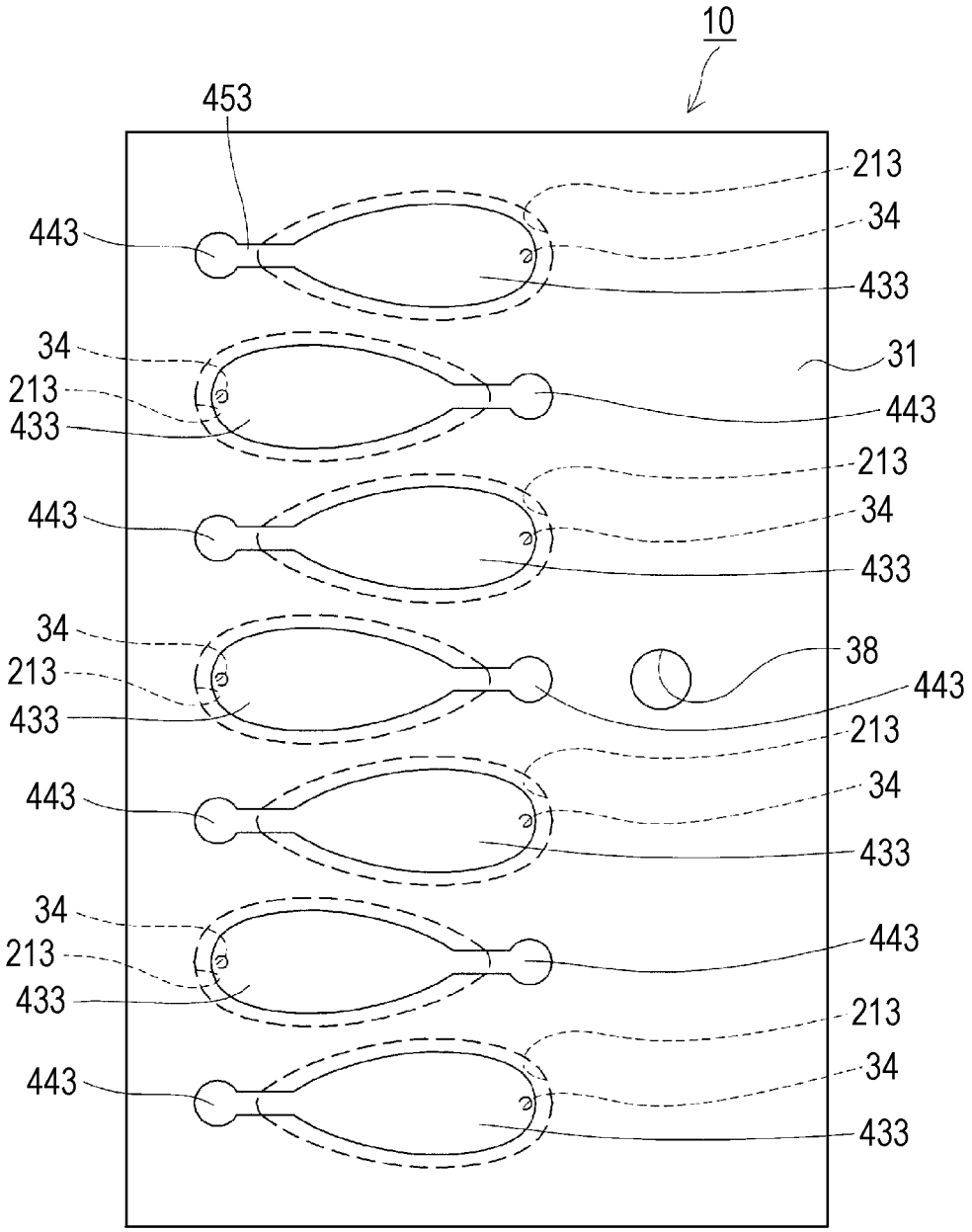
FIG. 5 is a plan view of essential parts for explaining a shape of a pressure generation chamber.

The shape or the like of the pressure generation chamber 21 which has the same operations and effects as those described above are not limited to what is illustrated in FIG. 2. It is preferable that the pressure generation chamber 21 has a structure in which an electrode protruding to the electrode pad side is more difficult to displace than the opposite side, and thus, for example, the shapes illustrated in FIGS. 3 to 5 are considered. A shape of a pressure generation chamber 211 illustrated in FIG. 3 is basically a combination of linear line, but a width of the pressure generation chamber 211 is gradually decreased toward an electrode pad 441 side. Here, an upper electrode film 431 is connected to the electrode pad 441 through a connection wire 451.

In addition, as illustrated in FIG. 4, pressure generation chambers 212 may be configured so as to be in a staggered arrangement in such a manner that a position of the pressure generation chambers adjacent in a direction in which the pressure generation chambers are provided in parallel is shifted with respect to a longitudinal direction (electrode pad 442 side). In this case, it is possible to further achieve high density of the nozzle openings 34. In addition, an upper electrode film 432 is connected to the electrode pad 442 through a connection wire 452.

Further, as illustrated in FIG. 5, pressure generation chambers 213 which are adjacent to each other in a direction in which the pressure generation chambers are provided in parallel may be alternately arranged, and even in this case, it is possible to achieve high density of the nozzle openings 34. Here, an upper electrode film 433 is connected to an electrode pad 443 through a connection wire 453.

Even in FIGS. 3 to 5, shapes of the upper electrode films 431, 432 and 433 which are integrated with the electrode pads 441, 442 and 443 are a little smaller than those of the pressure generation chambers 211, 212 and 213, but are similar to the shapes of the pressure generation chambers 211, 212 and 213. In this way, when the shapes of the upper electrode films 431 to 433 are similar to the shapes of the pressure generation chambers 211 to 213, the displacement of the piezoelectric element 40 is transferred most efficiently to ink in the pressure generation chambers 211 to 213. However, the shapes of the upper electrode films 431 to 433 are not limited thereto. Even when the pressure generation chamber has the shape as in examples described above, and the shapes of the upper electrode films 431 to 433 and the piezoelectric element 40 are rectangular shapes the same as those of the related art, although of a small degree, the same operations and effects as the above-described embodiments are obtained.

Figure 6:
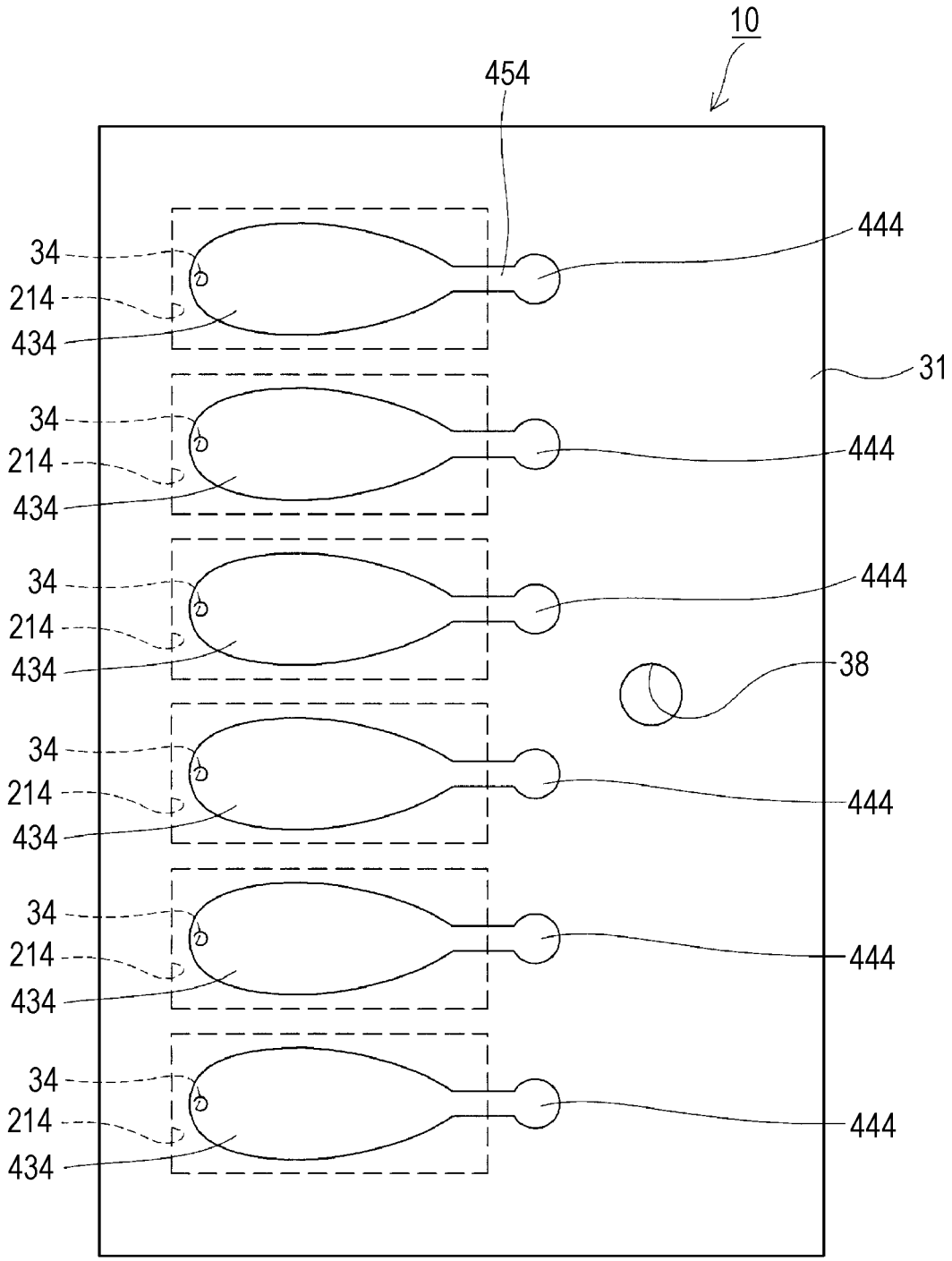
FIG. 6 is a plan view of essential parts for explaining a shape of a pressure generation chamber.

Further, as illustrated in FIG. 6, a pressure generation chamber 214 may have a rectangular shape which is the same as the related art, and only the shape of the piezoelectric element which includes an upper electrode film 434 integrated with an electrode pad 444 through a connection wire 454 may be the shape (the shape in FIG. 6 is the same as the shape in FIG. 2) illustrated in FIGS. 2 to 5. With respect to an improvement of displacement efficiency and a reduction of stress concentration, it is possible to obtain the same effects as a case where the pressure generation chambers 211 to 213 are formed in the shapes illustrated in FIGS. 2 to 5.

Figure 7:
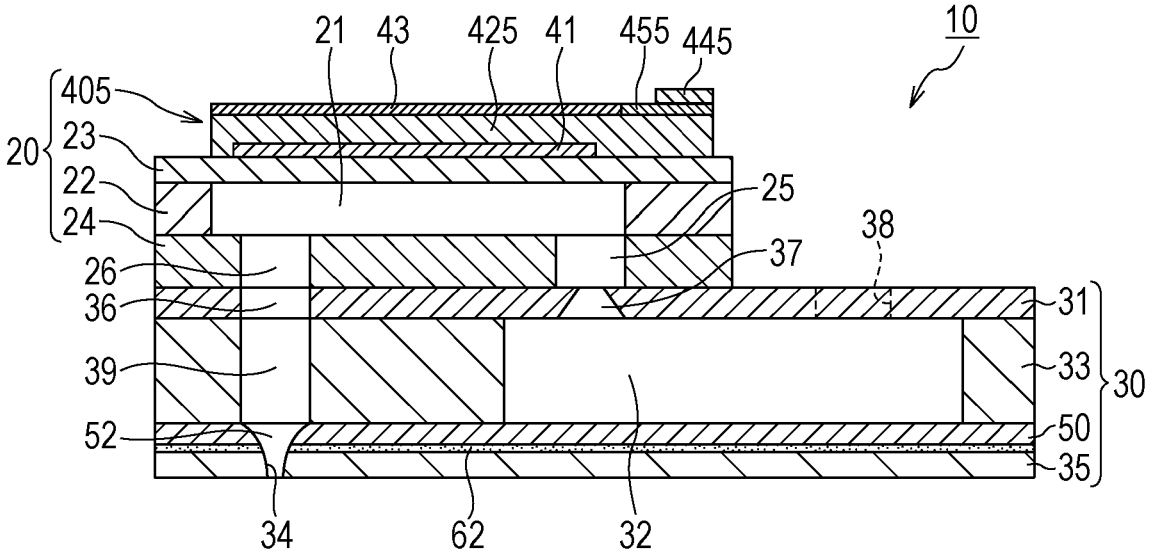
FIG. 7 is a sectional view of a recording head according to another embodiment of the present invention.
Figure 8:
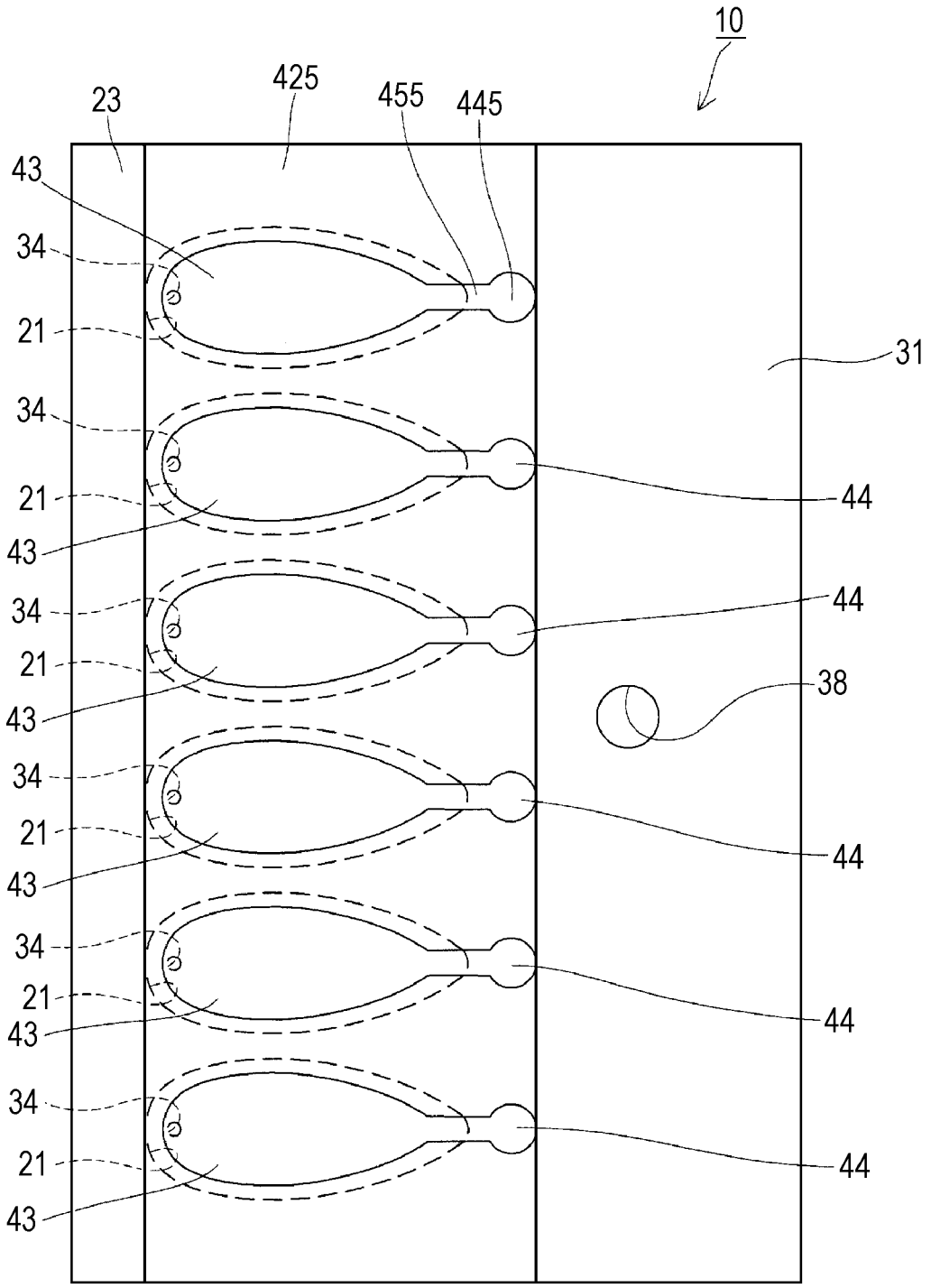
FIG. 8 is a plan view of essential parts for explaining a shape of the pressure generation chamber illustrated in FIG. 7.

In addition, as illustrated in FIG. 7 and FIG. 8 which is a plan view of FIG. 7, a piezoelectric layer 425 of a piezoelectric element 405 may be extended to a portion of an electrode pad 445, and be configured so as to be arranged on an entire surface of the vibration plate 23 in a width direction. Here, the upper electrode film 43 is connected to an electrode pad 445 through a connection wire 455.

ANOTHER EMBODIMENT

A description has been made of one embodiment above, but the basic configuration of the invention is not limited thereto. For example, in the above-described embodiment, the ink jet type recording head 10 with the piezoelectric element 40 of a thick film type is exemplarily illustrated. But, a pressure generation unit which generates a pressure change in the pressure generation chamber 21, is not particularly limited. For example, the same effect is obtained even when the ink jet type recording head 10 is an ink jet type recording head with, for example, a pressure generation unit which ejects ink droplet from the nozzle opening using deformation of a thin film type piezoelectric element which has piezoelectric material formed by a sol-gel method, a MOD method, a sputtering method or the like.

Figure 9:
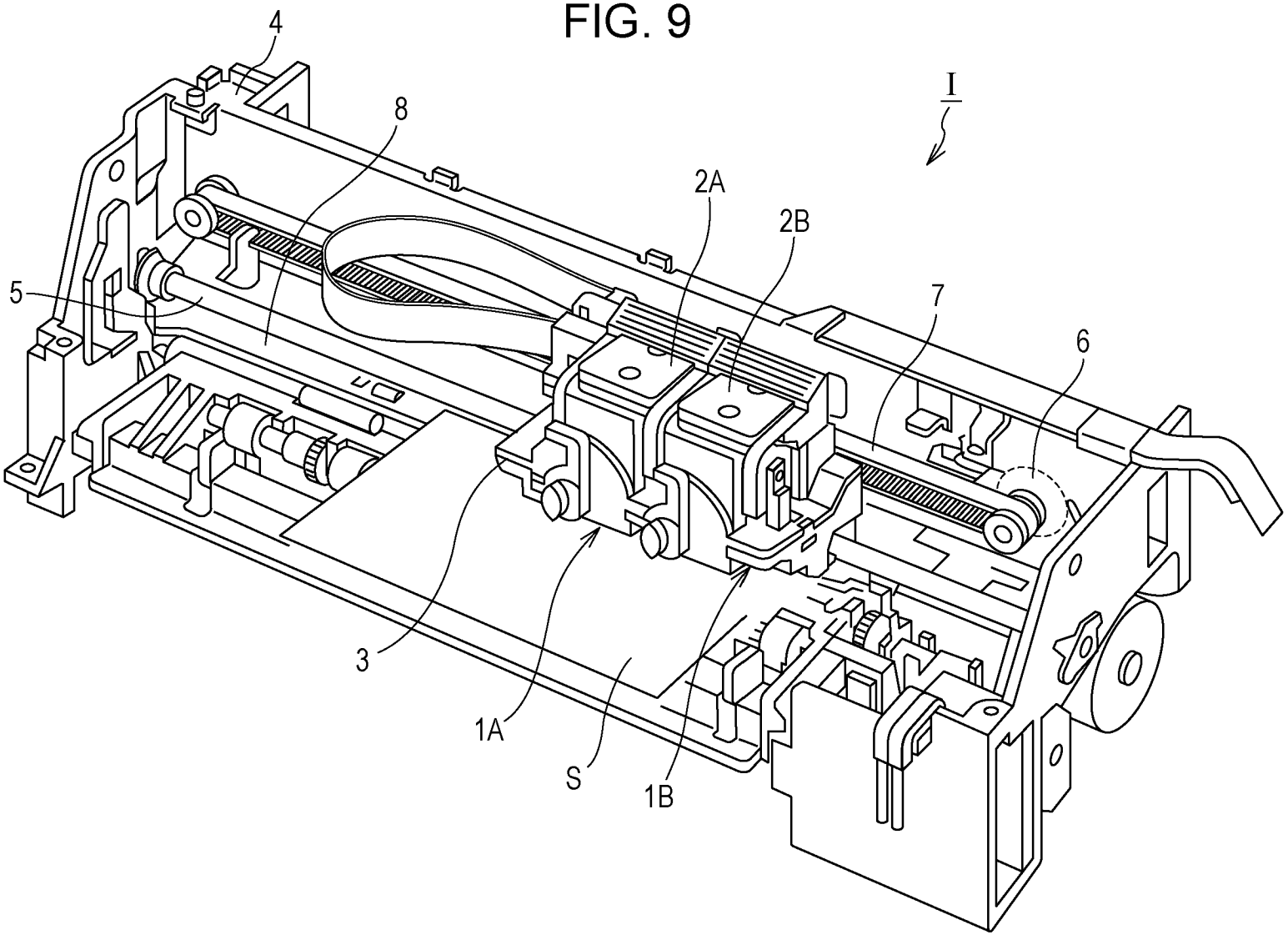
FIG. 9 is a schematic view of an ink jet type recording apparatus according to an embodiment of the present invention.

In addition, the ink jet type recording head according to the present embodiment configures a portion of a recording head unit which includes the ink flow path communicating with the ink cartridge or the like, and is mounted on an ink jet type recording apparatus. FIG. 9 is a schematic view illustrating an example of the ink jet type recording apparatus.

As illustrated in FIG. 9, the ink jet type recording apparatus I includes recording head units 1A and 1B which respectively have the ink jet type recording head 10. The recording head units 1A and 1B are provided such that ink cartridges 2A and 2B which configure ink supplying units can be detachable, and a carriage 3 on which the recording head units 1A and 1B are mounted is movably provided in a shaft direction on a carriage shaft 5 attached to an apparatus main body 4. For example, the recording head units 1A and 1B respectively eject black ink composition and color ink composition.

In addition, driving force of a driving motor 6 is transferred to the carriage 3 through a plurality of gears not illustrated and a timing belt 7, and thereby the carriage 3 on which the recording head units 1A and 1B are mounted moves along the carriage shaft 5. On the other hand, a platen 8 is provided along the carriage shaft 5 in the apparatus main body 4. A recording sheet S, which is a recording medium such as paper fed by a paper feeding roller or the like not illustrated, is wound around the platen 8 and is transported. Then, the pressure generation unit or the like of the driving motor 6 or the recording head units 1A and 1B is controlled to operate by a control unit configured by a CPU, memory or the like which is not illustrated.

In the above-described embodiments, the ink jet type recording head as an example of the liquid ejecting head is described, but the invention targets all liquid ejecting heads, and can also be applied to a liquid ejecting head which ejects any other liquid than ink. There are other liquid ejecting heads, such as various recording heads used for an image recording apparatus such as a printer, a color material ejecting head used for manufacturing a color filter such as a liquid crystal display, an electrode material ejecting head used for forming an electrode of an organic EL display, a field emission display (FED) or the like, or a bio-organic material ejecting head used for a biochip manufacture.

What is claimed is:

1. A liquid ejecting head, comprising:

a plurality of pressure generation chambers which are filled with liquid; and piezoelectric elements which eject liquid droplets through nozzle openings, wherein each piezoelectric element corresponds to one of the pressure generation chambers and applies pressure to the liquid in the corresponding pressure generation chamber;

wherein a portion of each piezoelectric element protrudes beyond a first end of the corresponding pressure generation chamber in a protrusion direction;

and wherein each pressure generation chamber has a shape such that a first width of the pressure generation chamber in a direction orthogonal to the protrusion direction, taken a predetermined distance from the first end of the pressure generation chamber, is narrower than a second width of the pressure generation chamber in the direction orthogonal to the protrusion direction, taken the predetermined distance from a second end of the pressure generation chamber, wherein the second end is opposite the first end.

2. The liquid ejecting head of claim 1, wherein the shape of the pressure generation chamber is such that a first additional portion of the piezoelectric element that is adjacent the second end of the pressure generation chamber is deformed more easily than a second additional portion of the piezoelectric element that is adjacent the first end of the pressure generation chamber.

3. A liquid ejecting apparatus comprising the liquid ejecting head according to claim 2.

4. The liquid ejecting head according to claim 1, wherein the piezoelectric element includes a common electrode which is common in the plurality of piezoelectric elements, a piezoelectric element layer, and an individual electrode which is provided in each piezoelectric element, and wherein the protrusion direction is a direction in which the individual electrode protrudes out of the pressure generation chamber.

5. The liquid ejecting head according to claim 4, wherein the individual electrode is formed along a shape of each pressure generation chamber.

6. A liquid ejecting apparatus comprising the liquid ejecting head according to claim 5.

7. The liquid ejecting head according to claim 4, wherein the individual electrode is formed in a rectangular shape.

8. A liquid ejecting apparatus comprising the liquid ejecting head according to claim 7.

9. A liquid ejecting apparatus comprising the liquid ejecting head according to claim 4.

10. The liquid ejecting head according to claim 1, wherein the pressure generation chambers are in a staggered arrangement in which a position of the nozzle opening corresponding to those adjacent in a direction, which is orthogonal to the protrusion direction and in which the pressure generation chambers are provided in parallel, is shifted with regard to the protrusion direction.

11. A liquid ejecting apparatus comprising the liquid ejecting head according to claim 10.

12. The liquid ejecting head according to claim 1, wherein one of the pressure generation chambers adjacent in the direction in which the pressure generation chambers are provided in parallel is disposed such that the protrusion direction thereof is opposite the protrusion side of other pressure generation chambers which are mutually adjacent to the one of the pressure generation chambers.

13. A liquid ejecting apparatus comprising the liquid ejecting head according to claim 12.

14. A liquid ejecting apparatus comprising the liquid ejecting head according to claim 1.

* * * * *